United States Patent [19]

Melandri

[11] 4,158,332

[45] Jun. 19, 1979

[54] CONTINUOUS CYCLE DEMUSTER PRESS WITH COAXIAL PISTONS

[75] Inventor: Primo Melandri, Lugo, Italy

[73] Assignee: Diemme S.p.A., Lugo, Italy

[21] Appl. No.: 882,164

[22] Filed: Mar. 1, 1978

[30] Foreign Application Priority Data

Mar. 7, 1977 [IT] Italy ..... 46830 A/77

[51] Int. Cl.[2] ..... B30B 9/06

[52] U.S. Cl. ..... 100/127; 100/51; 100/116; 100/139; 100/185

[58] Field of Search ..... 100/116, 126, 127, 128, 100/129, 37, 35, 137, 139, 147, 148, 117, 50, 51, 49, 48, DIG. 5, DIG. 9, 185

[56] References Cited

U.S. PATENT DOCUMENTS

| | | | |
|---|---|---|---|
| 604,348 | 5/1898 | Bussells | 100/127 X |
| 2,817,288 | 12/1957 | Peters | 100/127 X |
| 3,384,007 | 5/1968 | Boje et al. | 100/229 A |
| 3,789,752 | 2/1974 | Wirz | 100/127 |

*Primary Examiner*—Peter Feldman

*Attorney, Agent, or Firm*—Brisebois & Kruger

[57] ABSTRACT

Continuous cycle demuster press consists of perforated cylinder divided into two portions, a cylindrical pressing piston inside a smaller section downstream portion, and annular piston being disposed inside a larger section upstream portion; the two pistons are coaxial, and the annular piston is disposed between the skirt of the smaller piston and the larger perforated cylinder.

9 Claims, 3 Drawing Figures

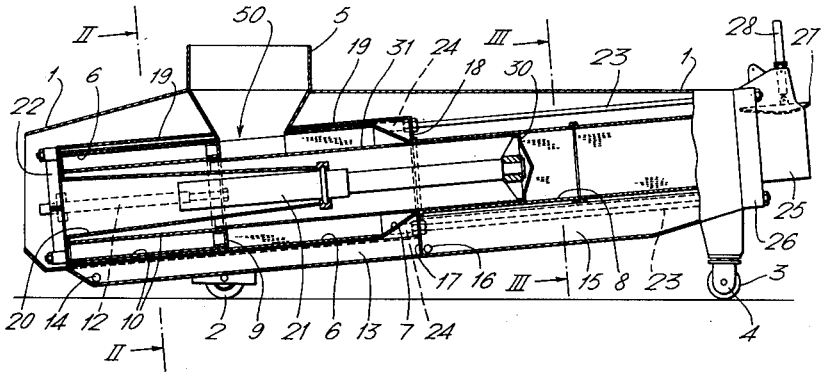

CONTINUOUS CYCLE DEMUSTER PRESS WITH COAXIAL PISTONS

SUMMARY OF THE INVENTION

The present invention relates to a demuster press of the coaxial piston type which, working in a continuous cycle, enables demusting and pressing to be carried out separately during the same operating cycle.

More precisely, the machine according to the invention enables multiple stage demusting and single stage pressing to be carried out.

At the present time, in the wine making industry, the demusting and pressing of the pressed or stalk-stripped grape are carried out by piston or screw machines, these components being disposed inside perforated cylinders or sieves which are fed with the product to be pressed.

Both types of machine normally used have serious drawbacks.

With regard to demuster presses comprising one or more pistons in series, although they enable a pure must typical of horizontal presses to be obtained, they are of intermittent operation with a low hourly production rate, which during the grape harvest is a series disadvantage.

With regard to screw presses, although they allow continuous operation and a high production rate, they are extremely costly and of long and complicated construction, particularly with regard to the screws themselves.

The object of the present invention is to provide a continuous cycle demuster press of the piston type which, although of simple, rational and highly reliable construction, obviates the aforesaid drawbacks.

The proposed machine in fact combines the merits of screw presses, i.e. continuous operation with a high must production rate, with the merits of horizontal piston presses, i.e. a pure must free from dregs.

According to the invention, this is attained by a sieve of different diameter sections, the greater section of which, housed in the rear part of the machine, is fed from a normal feed hopper.

The greater and smaller sections of the sieve are connected together by a perforated cone frustum connector which defines a chamber for feeding the sieve of smaller section from the sieve of greater section.

In the sieve or perforated cylinder of greater section, used for the demusting, there is an annular piston which, when in its completely withdrawn position, is upstream of the feed hopper. The annular piston is provided with a skirt, the length of which is such as to keep the mouth of the feed hopper closed when the said annular piston is in its completely advanced position. The annular piston lies during its stroke between the sieve of greater diameter and the skirt of a press piston coaxial thereto, which is inserted into and slides inside the sieve of smaller diameter.

Finally, at the end of the smaller diameter or pressing sieve, there is disposed a swinging shutter, the degree to which it opens or closes the discharge port being adjustable.

Further objects and advantages, together with the operational characteristics and constructional merits of the invention, will be more evident from the detailed description given hereinafter with reference to the figures of the accompanying drawings which illustrate a preferred embodiment thereof by way of non-limiting example.

Figure 1:
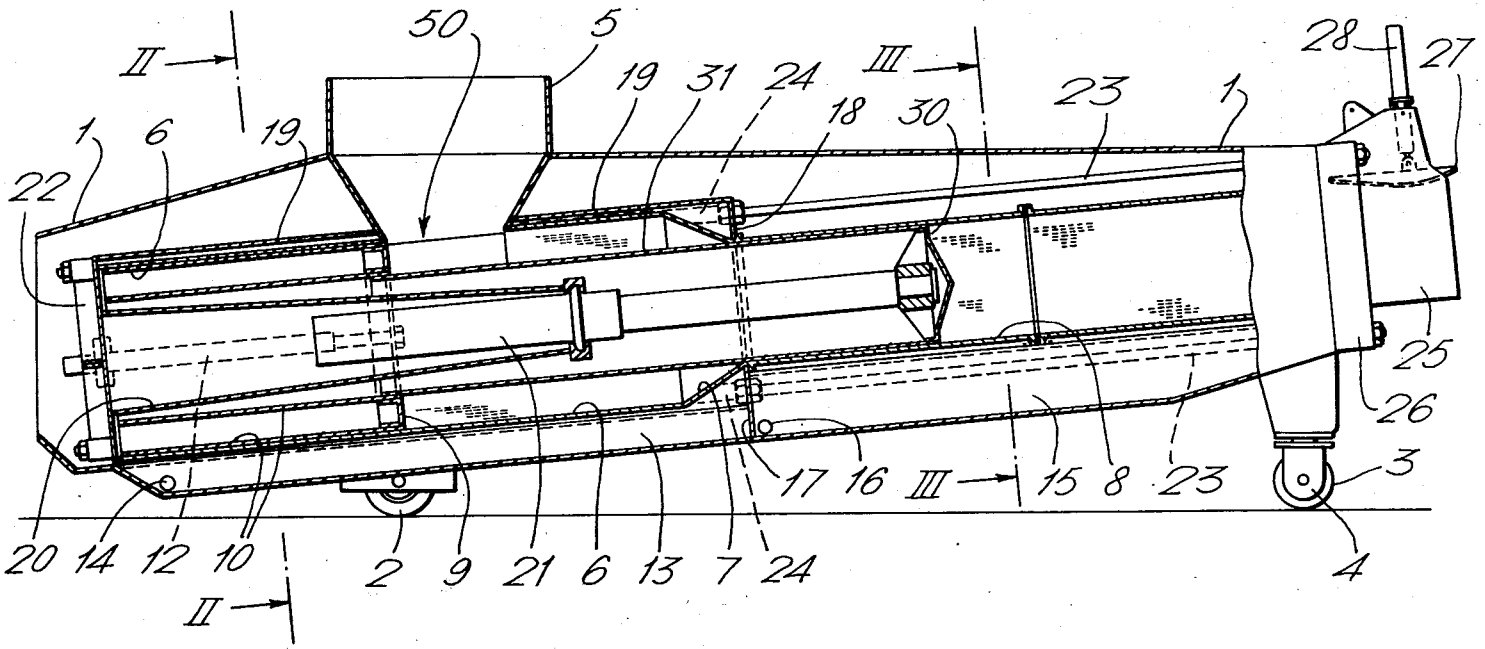
FIG. 1 is a longitudinal section in front elevation of a press according to the invention.
Figure 2:
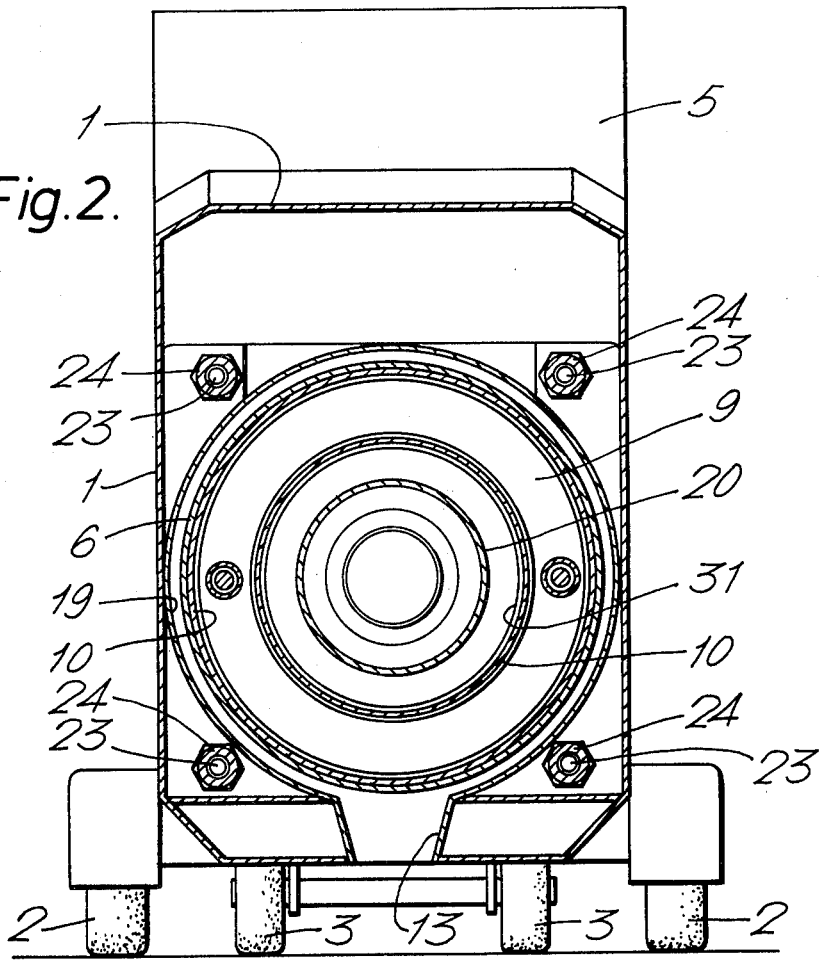
FIG. 2 is a view in section taken along line II—II of FIG. 1.

With particular reference to FIG. 1, there is shown a perforated cylinder or sieve which is slightly inclined to the horizontal and is housed in a casing 1. This latter is supported by a pair of rear wheels 2 and a pair of front wheels 3 which are mounted on swivel wheel supports 4.

The sieve is constituted essentially by two different diameter sections of which the greater section, namely the rear section, defines a demusting sieve or first cylinder 6.

The demusting sieve 6 is connected by means of a cone frustum connection piece 7 to a press sieve or second cylinder 8 housed in the front region of the machine. This latter sieve, as clearly indicated in FIG. 1, has a diameter less than the demusting sieve 6. The demusting sieve 6 is surrounded by a jacket 19 which, in its bottom region, is connected to a rear collection tank 13 provided with at least one discharge port 14.

The rear of the jacket 19 and demusting sieve 6 are closed by a plate 22 from which four parallel cylindrical rods 23 extend. The rear region of said cylindrical rods 23 is provided with suitable distance pieces such as spacer sleeves 24 and are connected to an intermediate plate 18 separating the cone frustum connection piece 7 from the press sieve 8.

Figure 3:
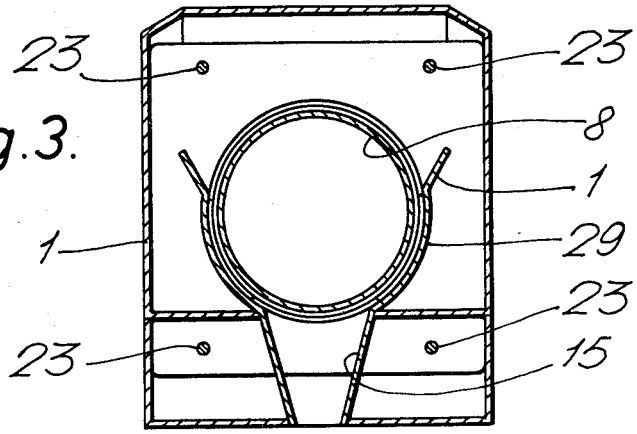
FIG. 3 is a view in section taken along line III—III of FIG. 1.

With reference to FIGS. 1 and 3 together, it can be seen that the press sieve or second perforated cylinder 8 is surrounded, at least over its central and lower regions, by a collection tray 29 which is connected at its bottom to a collection tank 15 provided with at least one must discharge port 16. The front collection tray 15 and rear collection tray 13 are separated by a removable baffle 17 connected to the intermediate plate 18.

Outside the press sieve 8 are the front portions of the cylindrical rods 23, which extend into the front region of the machine to reach a plate 26 to which they are connected at their front ends. A discharge piece 25 extends forwardly from plate 26 in alignment with the press sieve 8, and its mouth is partly or completely opened or closed by a swing shutter 27. Shutter 27 is hinged to the plate 26, and is connected essentially in its central region to the rod of a double acting hydraulic cylinder-piston unit 28, the casing of which is hinged to the discharge piece 25.

The upper rear region of the casing 1 is provided with a feed hopper 5, the lower moutn 50 of which opens through sieve L so that the hopper communicates with the interior of the demusting sieve 6. A cone support sleeve 20 extends from the inner face of the plate 22, and its free end supports a double acting hydraulic cylinder-piston unit 21, with a pressing piston 30 connected to the end of its rod.

In FIG. 1, which shows the double acting cylinder-piston unit 21 with its rod completely extended, it can be seen that a cylindrical skirt 31 branches from the piston 30 and extends until its free rear end reaches that region of the demusting sieve 6 which lies immediately upstream of the mouth 50 of the feed hopper 5. An annular piston 9 is disposed in said region immediately upstream of the mouth 50 between the free end of the skirt 31 and the demusting sieve 6, and is connected to the rods of two double acting hydraulic cylinder-piston units 12, which are disposed respectively on opposite sides of the machine with their casings connected to the plate 22. Two concentric cylindrical skirts 10 extend from the inner and outer edges of the annular piston 9 such that they are contained within the toroidal space defined by the skirt 31 of the piston 30 and the demusting sieve 6. The double acting cylinder-piston units 12 are housed in the annular space defined by the pair of concentric skirts 10 of the annular piston 9.

Lastly, although not illustrated for clarity and simplicity of drawing, the double acting cylinder-piston units 21 and 28, and the pair of lateral hydraulic jacks 12, are connected to a suitable hydraulic power circuit provided with suitable distributors and adjustable timers, together with a suitable adjustable counter to select the number of strokes of the annular demusting piston 9. Although not shown for clarity and simplicity of drawing, the hopper 5 is provided with two suitable switches, one for maximum level and the other for minimum level.

The operation of the described demuster press is as follows.

With reference to the operating position shown in FIG. 1, at the beginning of operation the machine is adjusted in accordance with the required demusting and pressing pressures in the demusting sieve 6 and press sieve 8 respectively. The pressed or stalk-stripped grapes are fed from the outside into the feed hopper 5, and from here, via the feed mouth 50, they reach the toroidal interspace defined by the demusting sieve 6 and the rear part of the skirt 31 of the press piston 30. Thus, at the beginning of the operation, the annular piston 9 is completely withdrawn such that its front face is slightly upstream of the feed mouth 50, whereas the piston 30 is in a completely extended position.

At a certain point, the annular piston begins to advance so that it drives the mass of pressed or stalk-stripped grape received into said toroidal interspace towards the front region of the machine. During its stroke, the outer skirt 10 of annular piston 9 closes the feed mouth 50, while the front face of the piston demusts the mass of grapes, which are driven into the annular volume defined by the front face of the annular piston 9, the inner surface of the sieve 6 and cone frustum connection piece 7, and the outer surface of the skirt 31 of the piston 30.

The demusting pressure is normally 3 kg/cm$^2$, but can vary, or be adjusted to a convenient value, according to the characteristics of the product to be demusted.

The advancement of the annular piston 9 is timed such that for the entire predetermined time of demusting, which is adjustable, the demusting pressure always remains the same. Such constant demusting pressure is continuously provided by a pump of variable output, which operates the hydraulic jacks 12 and is provided with a pressure control valve to adjust the output into said hydraulic jacks 12. After the predetermined time interval, the timer for the annular piston 9 switches over and feeds a signal to the hydraulic power circuit in order to cause the annular piston 9 to return rapidly.

In this manner, while the piston 30 is in its completely extended position and piston 9 is retracted, the said toroidal interspace is again filled through the thus open feed mouth 50.

Immediately afterwards, a second demusting stage is effected by the annular piston 9 which presses the new mass of pressed or stalk-stripped grapes against the mass which was previously demusted. Again, as stated, the demusting pressure is kept constant for the entire period during which the annular piston 9 is active. During said demusting, the liquid leaving the pressed mass passes through the holes or slots in the demusting sieve 6 to reach the interspace defined by the sieve 6 and jacket 19.

The liquid which thus emerges is collected by the jacket 19 which conveys it downwards where it reaches the collection tank 13, and from which it leaves through the discharge port 14.

After a determined number of demusting stages, this number being measured by a suitable counter, the annular piston 9 remains in its completely extended position to keep the mass compressed, whereas the piston 30 withdraws rapidly by means of a suitable signal. When the front face of the piston 30 comes into the proximity of the cone frustum connecting piece 7, the mass which is constantly pressed by the annular piston 9 is fed into the press sieve 8, through the space then formed between the piston 30 and cone frustum connection piece 7.

Because of the variable throughput pump, even during the passage of the pressed mass from the demusting sieve 6 to the press sieve 8, said mass is kept at the demusting pressure to which it was previously subjected.

In this respect, the constant pressure applied by the annular piston 9, the configuration of the cone frustum connection piece 7 and the circumferential edge of the piston 30 help during said transfer to crumble said mass so that the subsequent press stage is greatly facilitated and made more complete, in that any pockets of liquid formed during the demusting stage are broken up, with the consequent recovery of this enclosed liquid which would otherwise be very difficult to recover in the subsequent pressing stage if the demusted mass were not crumbled.

After the annular piston 9 feeds the demusted mass into the press sieve 8, the double acting cylinder-piston unit 21 is operated by a suitable switch, and causes the piston 30 to slide very slowly towards the discharge piece 25. At the same time, the annular piston 9 sets its timer and counter to zero, and simultaneously withdraws rapidly to begin a new cycle of demusting stages. The press piston 30 carries out its pressing stage in an adjustable predetermined time, at the end of which it returns rapidly to receive a new or subsequent demusted mass.

The pressing pressure inside the sieve 8 is determined by the position of the shutter 27 relative to the mouth of the discharge piece 25.

From this moment onwards, the operations follow each other in the manner heretofore described.

As stated, the pressing stroke of the piston 30 takes place over a predetermined adjustable time period which lies between a maximum and a minimum value. If the time required for the pressing operation exceeds the maximum limit, which signifies that the pressed column of material is too long in length, the hydraulic circuit of the machine becomes set so that on its next working stroke the piston 30 travels at a greater speed so as to carry out a longer stroke and therefore reduce the length of the pressed column.

In contrast, if the time used for the pressing operation is less than the minimum limit of the predetermined time period, which signifies a column of material which is too short, the hydraulic circuit of the machine becomes set such that the next stroke is made at a lower speed, while the column becomes lengthened. If it is not possible to reach the necessary pressing pressure even with the pressed material column at its maximum length, the shutter 27 closes automatically.

The described operation is completely automatic, but the machine is provided with suitable controls to enable the said operations to be controlled manually.

The demusting and pressing stages are related in time, but are operationally independent. This is clearly a considerable advantage in that the demusting and pressing stages, which have considerably different characteristics, are carried out independently and separately.

The liquid leaving the press sieve 8 is collected by the tank 15, from which it leaves through the discharge port 16.

However, if required, as the baffle 17 is removable, the liquid leaving the press sieve 8 can mix with the liquid leaving the demusting sieve 6, and both liquids can discharge through the rear discharge port 14.

Furthermore, as the length of the material column in the sieve 8 and the position of the shutter 27 are adjusted by the same hydraulic power unit, this means that the pressing stage takes place at substantially constant pressure.

Finally, the maximum level switch provided on the feed hopper 5 stops the feed of pressed or stalk-stripped grapes to the feed hopper 5 to prevent said pressed or stalk-stripped grapes from overflowing from the upper mouth of said hopper, and the minimum level switch provided on the feed hopper 5 stops the machine when there is insufficient material to ensure sufficient filling of the sieve 6.

The invention is not limited to the single embodiment heretofore described, and modifications and improvements may be made thereto without leaving the scope of the inventive idea, the characteristics of which are summarised in the following claims.

What is claimed is:

1. A demuster press comprising a first perforated cylinder, a second perforated cylinder axially aligned with the first cylinder, said second cylinder having a diameter smaller than the first cylinder, means connecting said first cylinder to said second cylinder so that said second cylinder forms a smaller diameter extension of the first cylinder, a cylindrical pressing piston inside said second cylinder, said pressing piston having a skirt extending into said first cylinder, an annular demusting piston in said first cylinder between said skirt and said first cylinder, means defining an opening for feeding a material to be demusted into said first cylinder, means for moving said demuster piston toward said second cylinder to demust material in the first cylinder, means for moving said pressing piston into said second cylinder to compress material in the second cylinder and including means to withdraw the pressing piston from the second cylinder so that the demusting piston can force material from the first cylinder into the second cylinder.

2. A demuster press as claimed in claim 1, wherein said means connecting said first cylinder to said second cylinder comprises, a cone frustum having a perforated wall.

3. A demuster press as claimed in claim 1, wherein the demuster piston includes a skirt which comprises two concentric cylindrical walls between which two hydraulic jacks are laterally and symmetrically disposed, each jack having a rod the end of which is connected to a head portion of the annular piston, the jacks being supported by a plate which closes a rear mouth of the first cylinder, said jacks comprising said means for moving the demuster piston.

4. A demuster press according to claim 3, wherein said means for moving said pressing piston comprises, a double acting cylinder-piston unit having a rod connected to said pressing piston, and a support concentric with said demuster piston connecting the casing of the cylinder to said plate.

5. A demuster press as claimed in claim 1, wherein said demuster piston includes a skirt and when the demuster piston is completely advanced, its skirt totally closes the feed opening of the first cylinder.

6. A demuster press as claimed in claim 1, wherein when the demusted piston is completely withdrawn, its head is upstream of the feed opening of the first cylinder.

7. A demuster press as claimed in claim 2, wherein when the pressing piston is completely withdrawn, its head is slightly upstream of the cone frustum between the first cylinder and the second cylinder.

8. A demuster press according to claim 1, further comprising a shutter at a discharge mouth of said second cylinder, and a hydraulic cylinder unit for operating said shutter.

9. A demuster press according to claim 8 wherein, said means for moving said demuster piston comprises a hydraulic cylinder, and said means for moving said pressing piston comprises a hydraulic cylinder.

* * * * *